US006357572B2

(12) United States Patent
Kubota

(10) Patent No.: US 6,357,572 B2
(45) Date of Patent: Mar. 19, 2002

(54) TURNING-AROUND-TYPE CONTINUOUS CONVEYING APPARATUS

(76) Inventor: Masao Kubota, 22-7, Narimasu 2-chome, Itabashi-ku, Tokyo, 175-0094 (JP)

( * ) Notice: Subject to any disclaimer, the term of this patent is extended or adjusted under 35 U.S.C. 154(b) by 0 days.

(21) Appl. No.: 09/846,268

(22) Filed: May 2, 2001

Related U.S. Application Data

(62) Division of application No. 09/375,386, filed on Aug. 17, 1999, now abandoned.

(30) Foreign Application Priority Data

Aug. 18, 1998 (JP) ..... 10-267183

(51) Int. Cl.[7] ..... B66B 21/00
(52) U.S. Cl. ..... 198/321; 198/839
(58) Field of Search ..... 198/321, 324, 198/328, 334, 792, 831, 839

(56) References Cited

U.S. PATENT DOCUMENTS

| | | | | |
|---|---|---|---|---|
| 629,289 A | * | 7/1899 | Dodge | 198/328 |
| 747,090 A | * | 12/1903 | Schmidt et al. | 198/334 |
| 3,179,238 A | | 4/1965 | Patin | |
| 4,655,340 A | | 4/1987 | Steel | |
| 5,622,246 A | | 4/1997 | Kubota | |
| 6,145,653 A | | 11/2000 | Mensch | |

FOREIGN PATENT DOCUMENTS

| | | |
|---|---|---|
| EP | 0443039 | 8/1996 |
| JP | 58-2181 | 1/1983 |
| JP | 2-282186 | 11/1990 |

* cited by examiner

*Primary Examiner*—Joseph E. Valenza
(74) *Attorney, Agent, or Firm*—Staas & Halsey LLP

(57) ABSTRACT

A continuous conveying apparatus of an unified going/returning way type in which tread faces can be turned around with driving elements (chains or the like) on both sides of the tread faces maintained. A movable member having tread faces is turned helicoidally by 180° around an axis which extends in a plane parallel to the reference plane of the tread faces and is inclined at an angle of 45° with respect to the traveling direction. Then, the movable member travels horizontally and turned helicoidally by 180° around another axis which is inclined oppositely to the aforementioned axis. Thus, the movable member travels in the direction opposite to the going direction. In the case where the movable member is a train of rigid tread steps, it is preferable that each tread step is divided in left and right halves, the left and right halves are connected by an elastic pin so that they can take a twisted positional relationship, the left and right halves are each driven by a twistable roller chain and supported at three points by a driving roller and two adjusting rollers, and those rollers are each guided on a cylindrical guide surface. An escalator with inclined tread faces can be formed by providing low projections of trapezoid in cross section on a toothed in-part belt. There is also a structure in which each tread step stands up by being turned by 90° in a sloping section to turned around.

5 Claims, 11 Drawing Sheets

FIG. 13a
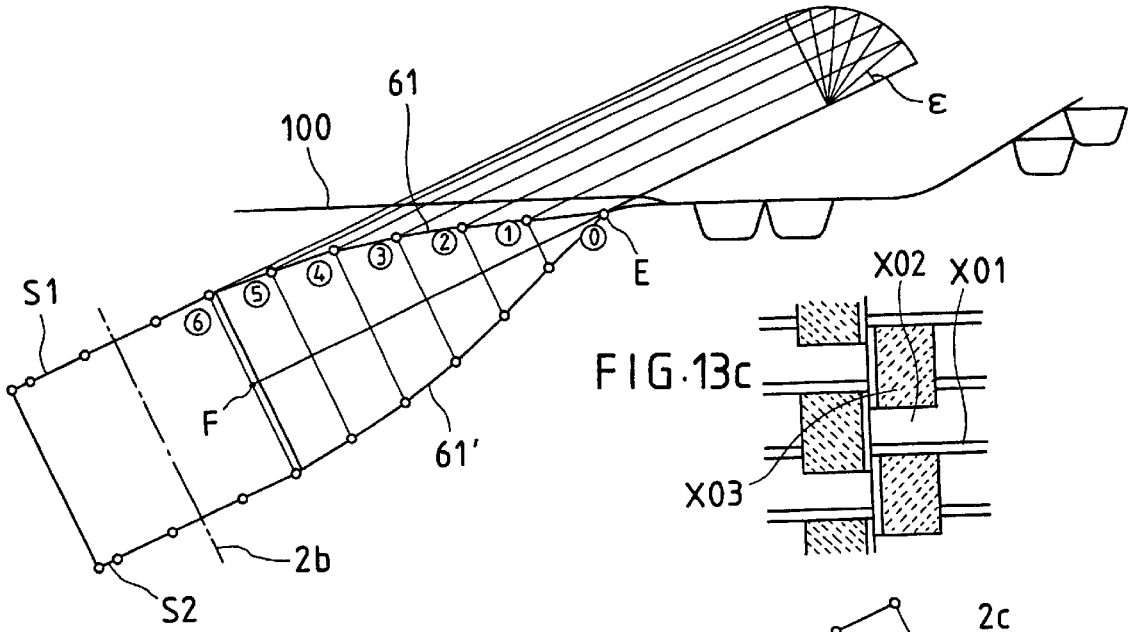
FIG. 13c
FIG. 13b
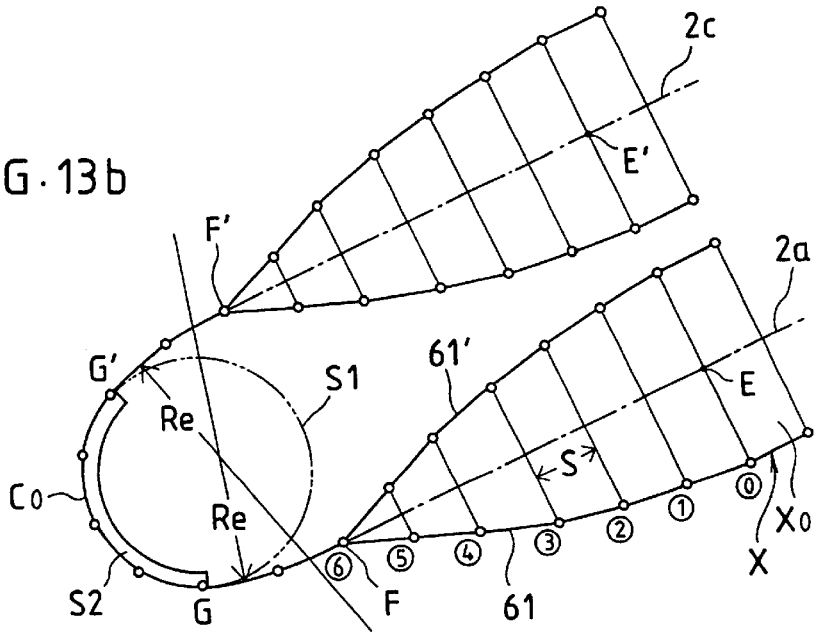

TURNING-AROUND-TYPE CONTINUOUS CONVEYING APPARATUS

This application is a Divisional of application Ser. No. 09/375,386, filed Aug. 17, 1999, now abandoned.

BACKGROUND OF THE INVENTION

1. Field of the Invention

The present invention relates to a continuous conveying apparatus in which going and returning ways are unified three-dimensionally, so as to contribute to saving of materials, simplification of structure, reduction of installation expenses and reduction of energy consumption in an escalator, a moving walk, a moving slope, and a conveyer for articles.

2. Description of the Related Art

In known escalators, moving walks and the like of an unified going/returning way type, tread faces move two-dimensionally in a turning around section. Therefore, those escalators and the like can not be provided with driving elements (roller chains, link series or racks) on both sides of steps as in ordinary escalators and the like, and they are allowed to have a continuous driving element only at one position in an inner or central area of the steps. This makes the tread faces unstable during traveling and complicates the structure of the escalators and the like. Thus, many inventions have been made on this type of escalators and the like, but there is not any invention in practical use.

SUMMARY OF THE INVENTION

An object of the present invention is to provide a continuous conveying apparatus of unified going/returning ways type, which has continuous driving elements on both sides of the tread faces in a turning around section.

A three-dimensional structure is necessary for turning around a straight-traveling belt member without stretching the same. Practically, there are a way of revolving tread faces helicoidally by 180° to reverse it, and a way of twisting the tread faces by 90° to stand it up. First, the way of 180° reversing will be described. In FIG. 1*a*, a belt member 1 traveling straight on a horizontal plane is wound on a horizontal cylinder 30 in contact with the belt member 1 on the lower side thereof with its axis inclined at an angle A to the traveling direction 1*a* of the belt member 1. The tread faces of the belt member 1 turns by 180° to form a helicoid, and then horizontally travels in a direction 1*b* which is inclined at an angle of 2(90°−A) with respect to the direction 1*a*. Then, the belt member 1 is wound onto a horizontal cylinder 40 (having the same diameter as the cylinder 30) in contact with the belt member 1 on the upper side thereof with its axis inclined at an angle B with respect to the direction 1*b*. The tread faces of the belt member 1 turns by 180° to form a helicoid, and then horizontally travels in a direction 1*c*. In order that the direction 1*a* and the direction 1*c* are parallel to each other, the following equation has to be satisfied based on the theorem of parallel lines.

$$2(90°-A)+2(90°-B)=180°$$

From this equation, A+B=90° is derived. Here, B is an angle formed by the horizontal cylinder 40 and the belt member 1 traveling in a direction 1*c* parallel to the direction la after the turn. If A=B, A=B=45°. This case is advantageous in respect of design and manufacture. The description will be hereinafter made on this case. In a case where a train of conveying members traveling on rails is used in place of a belt member, the train of conveying members are guided by helicoidal rails running around the axis 3*a* of the cylinder 30 and the axis 4*a* of the cylinder 40 instead of the cylinders 30, 40. Use of round bars or round pipes as rails facilitates the design and manufacture of the apparatus. In the following description, a horizontal plane is replaced by a slope plane in a case of running of the tread faces on a slope.

As shown in a plan view of FIG. 1*b* and a side view of FIG. 1*c*, when A=B=45°, the belt member 1 is guided helicoidally around the axis 3*a* which is below and parallel to the tread faces and inclined at an angle of 45° with respect to the traveling direction 1*a* toward the opposite traveling way, and a driving force transmitting mechanism operates. The contiguous tread faces are formed on twistable belt member 1. After the tread faces travel in the direction 1*b*, the belt member 1 moves to the opposite way by a helicoidal revolution around the axis 4*a* inclined at an angle of 45° in the opposite direction of the axis 3*a*, to complete the turn. With the three-dimensional structure, the belt member 1 can be turned with its driving mechanism maintained. A guide surface of the guide member operates to prevent the belt member from dropping off the course in the folding section. When the driving elements and supporting elements are provided on the back side of the belt member 1, enveloping surface of their movement generally form a helicoid. It is possible to increase the stability of operation by guiding the belt member by a guide face on the basis of a part of the helicoid.

In a case where a belt member is substituted by a train of steps interconnected and driven by roller chains, a left portion driven by a left roller chain and a right portion driven by a right roller chain have to take a twisted positional relationship in the helicoidal revolution. In this case, each step 5 is divided into left and right halves 51, 52, and the left and right halves are connected by a transverse cylindrical shaft 53 so that they can take the twisted positional relationship. Supporting rollers may be brought into contact with a cylindrical guide surface at one point and with an inclined posture, and guide rails may be formed of cylindrical tubes so as to simplify the guide surface.

In the case of twisting the tread faces by 90° to stand up, as shown in a side view of FIG. 13*a* and a plan view of FIG. 13*b*, a belt member 1 is helicoidally turned or twisted by 90° about an axis 2*a* which coincides with a central line of its traveling way in a sloping traveling section E→F, so that the tread faces stand up. After passing a buffer section FG, the belt member 1 is driven and guided circularly by a sprocket S1 and a circular guide S2 around an axis 2*b* in a circular turning section GG', and proceeds to a re-tuning section F'E' through a buffer section G'F'. In the re-turning section F'E', the belt member 1 is helicoidally turned or twisted with its tread faces laid, by 90° about an axis 2*c* which is parallel to the axis 2*a*, to travel on the opposite way.

BRIEF DESCRIPTION OF THE DRAWINGS

FIG. 2*a* is a plan view of a sloping traveling section;

FIG. 2*b* is a side view of the same;

FIG. 2*c* is a front view of a chain connecting portion;

FIG. 13*a* is a side view of a turn-around section with tread faces standing up for showing the motion of driving-chain receiving portions;

FIG. 13*b* is a plan view of the same on a plane perpendicular to an axis of the sprocket; and FIG. 13*c* is a plan view of edge portions of adjacent tread steps.

DETAILED DESCRIPTION OF THE PREFERRED EMBODIMENTS

Figure 1A:
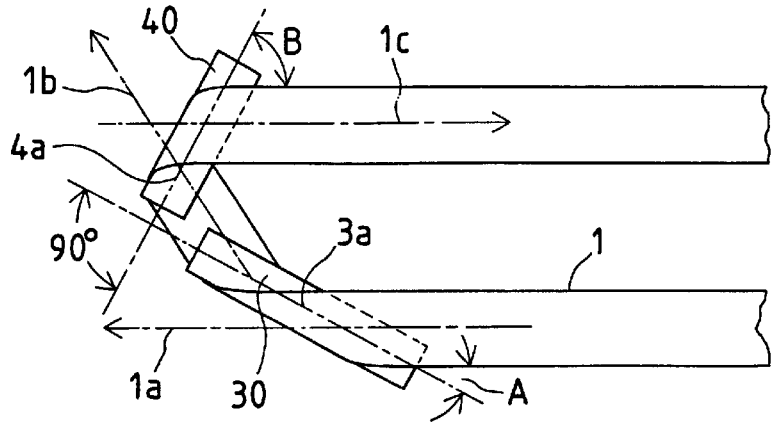
FIG. 1*a* is a plan view of a turn-around section of a continuous conveying apparatus using a toothed carrying belt, wherein the turn-around section has an asymmetric structure.
Figure 1B:
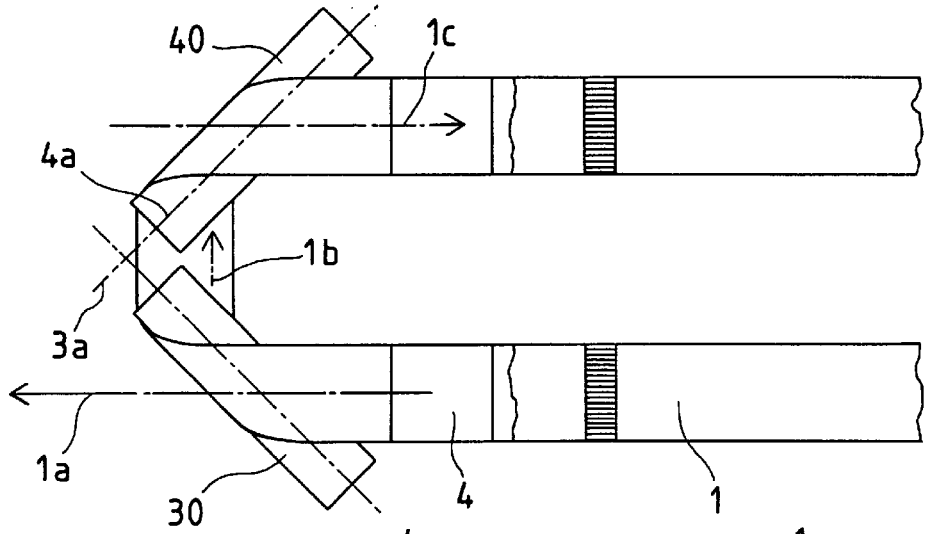
FIG. 1*b* is a plan view of a turn-around section of a continuous conveying apparatus using a toothed carrying belt, wherein the turn-around section has a symmetric structure.
Figure 1C:
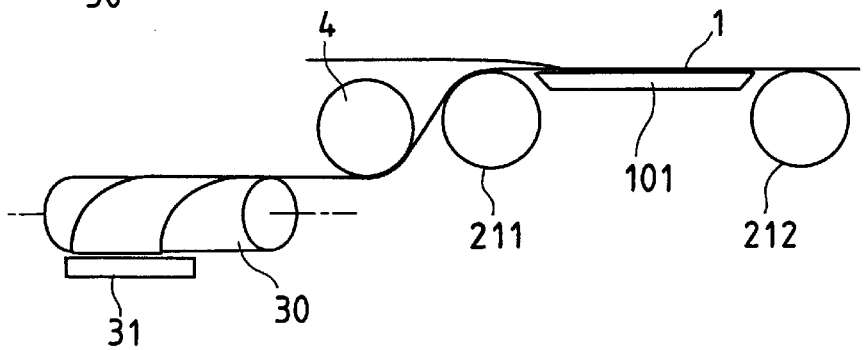
FIG. 1*c* is a side view of the turn-around section.

First, an embodiment in which tread faces are turned around by reversing will be described. As shown in a plan view of FIG. 1*b* and a side view of FIG. 1*c*, a belt member 1 which travels straight on a horizontal plane is wound on a cylinder 30 having the central axis 3*a* inclined at an angle of 45° with respect to the traveling direction 1*a* with the tread face turned by 180°, and then travels in the horizontal direction 1*b*. Then, the belt member 1 is wound on a cylinder 40 having the same diameter as the cylinder 30 and inclined oppositely to the cylinder 30 with the tread face turned by 180°. Then, the belt member 1 travels in a direction 1*c*. Here, the direction 1*c* is opposite to the direction 1*a*, and the tread face is not changed (not reversed). When driving elements and/or supporting elements are provided on the back side of the belt member 1, their enveloping surface generally forms a helicoid. So as to increase the stability of operation, the belt member 1 may be guided by a guide surface on the basis of a part of the helicoid.

(1) In the Case of a Flexible Loading Face

Figure 1D:
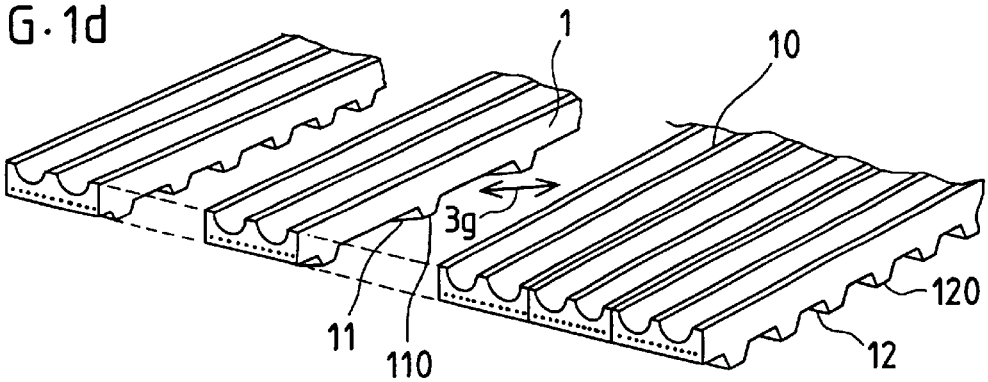
FIG. 1*d* is a perspective view of a toothed carrying belt.

The case where a toothed endless carrying belt 1 having a loading face 10 of flexible material such as hard rubber is used will be explained by an example. As shown in a perspective view of FIG. 1*d*, ribs 11 and teeth 12 are provided on the back side of the belt in a manner that the top flat faces 110 and 120 of the ribs 11 and teeth 12 which come in contact with a belt receiving plate 101 are parallel to the loading face 10. A plural number x (x=1, 2, 3, . . . ) of teeth 12 are provided on the back side of the belt over the width thereof to come in engagement with toothed belt wheels 2XY (x=1, 2, 3, . . . ; Y=1, 2, 3, . . . ) provided at a plurality of positions. The formation of ribs 11 is not limited to a specific one, but a grid inclined at angel of 45° having ribs parallel to the generating line 3*g* of the inclined cylinder is preferable in view of how the belt is in contact with the inclined cylinder 30. The top face on the back side of the carrying belt 1 is wound on the surface 30 of the rotatable cylinder 3 which is inclined at an angel of 45°, and there occurs a slip in the direction of the generating line of the cylinder though there occurs no slip in the circular direction thereof. In order to have a region for engagement of teeth near the turn-around portion and to impart tension to the belt in accordance with elongation of the belt 1, a tension cylindrical wheel 4 is provided to press the surface (loading face) 10 of the belt to thereby adjust the tension of the belt. The position where the tension cylindrical wheel 4 is mounted can be changed. The belt 1 is backed up by a line of back-up wheels 31 between the inclined cylinders 30 and 40. The top flat faces 110, 120 of the ribs and teeth of the toothed carrying belt 1 slide on the belt receiving plate 101. The carrying system is driven at a plurality of positions on the traveling route of the toothed belt.

(2) In the Case Where a Train of Tread Steps Driven by Roller Chains is Used

Figure 2A:
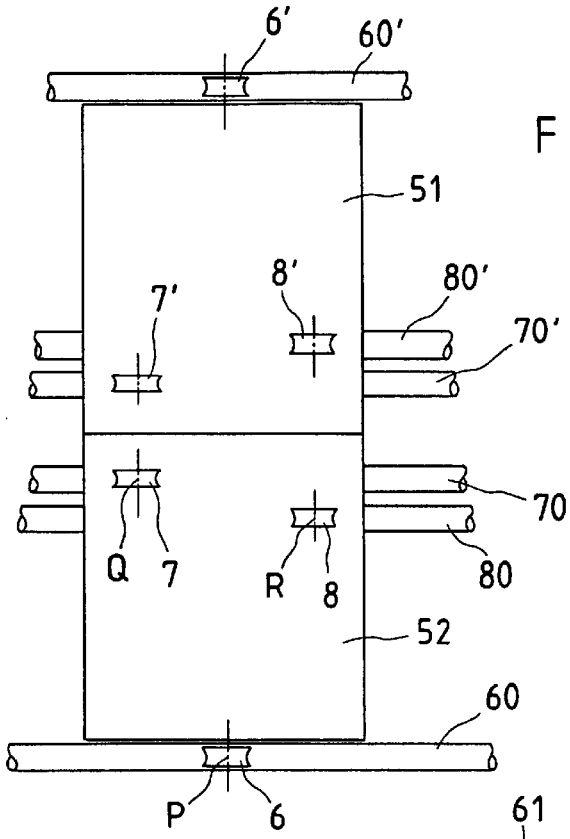
FIGS. 2*a* to 2*c* show a continuous conveying apparatus using a train of tread steps driven by roller chains.
Figure 2B:
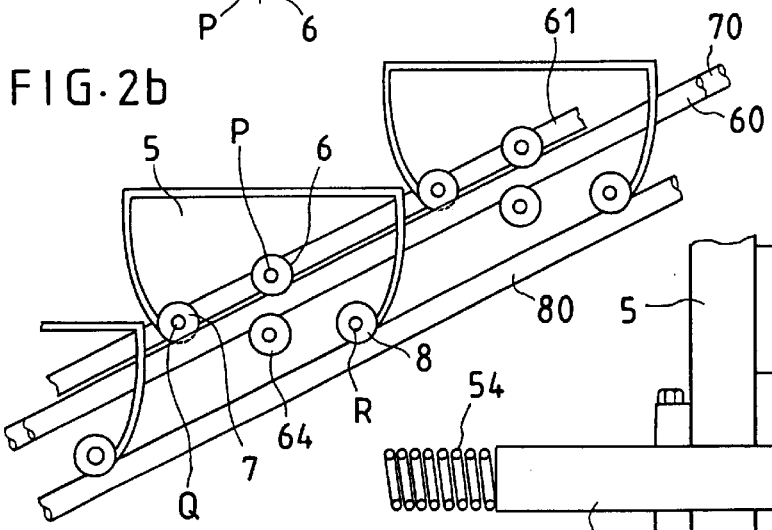
Figure 2C:
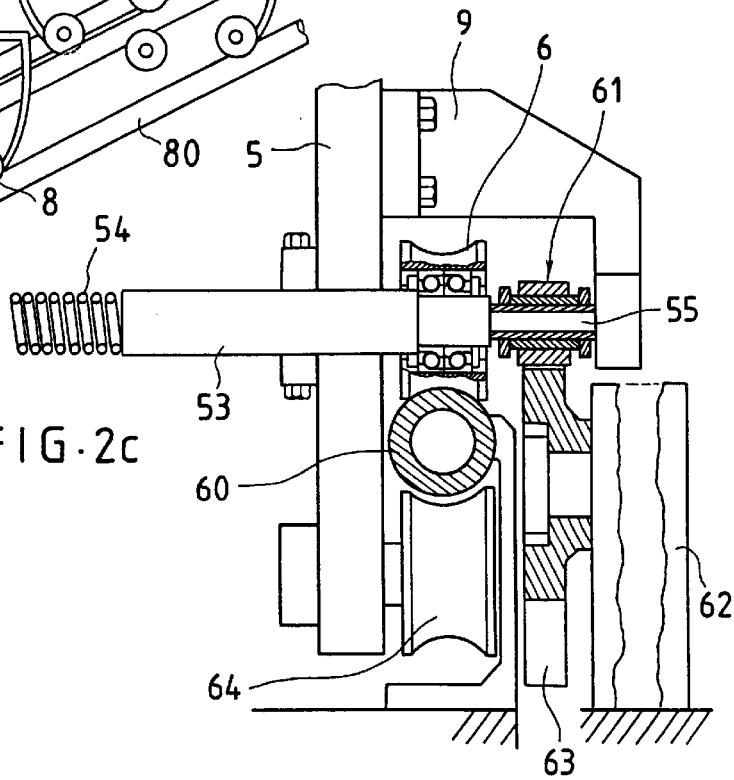
Figure 3A:
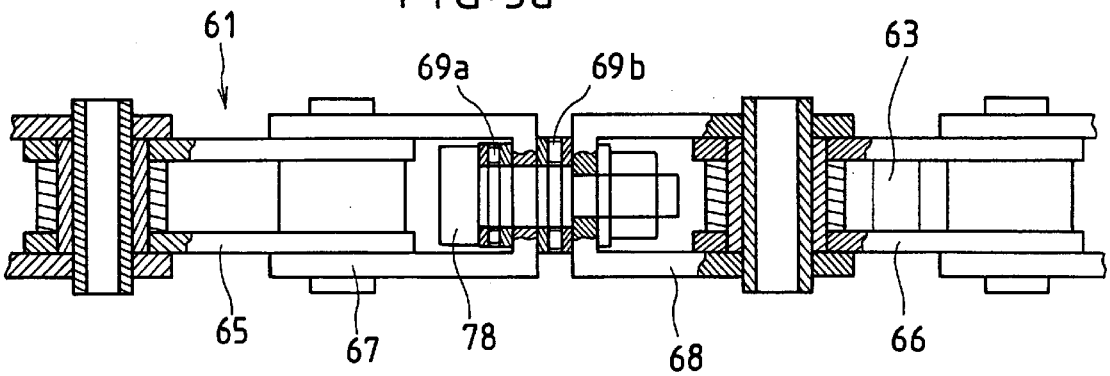
FIG. 3*a* is a side view of a twistable roller chain.
Figure 3B:
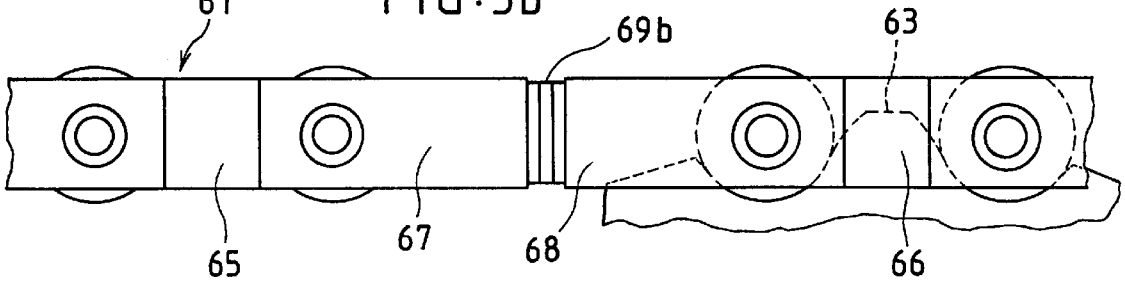
FIG. 3*b* is a plan view of the same.

The time when the left side of a tread step goes around an inclined axis and the time when the right side thereof goes around the inclined axis are different. Therefore, as shown in a plan view of FIG. 2*a*, the tread step 5 is divided into a left half 51 and a right half 52. The left and right halves 51, 52 are flexibly connected by a pin 53 which is concentric with left and right driving rollers and a spring 54 which is interposed to function as a part of the pin 53, and the left side of the left half 51 and the right side of the right half 52 are respectively driven by a twistable roller chain 61 as shown in FIGS. 3*a* and 3*b* throughout the going and returning ways. The roller chain 61 has a structure whereby U-shaped links 67, 68 joined to roller links 65, 66 by pins are connected by a longitudinal bolt 78 using thrust needle roller bearings 69*a*, 69*b*. Rollers for supporting the tread face and maintaining the attitude thereof are also provided. Guide faces for the rollers are arranged below the tread face. As shown in a side view of FIG. 2*b*, the center of the axis of a driving roller 6 is at the top P of an isosceles triangle whose perpendicular to the base coincides with the perpendicular bisector of the tread face, and the centers of the axes of adjusting rollers 7 and 8 are at both ends Q and R of the base of that isosceles triangle. As the guide faces 60, 70 and 80 for the rollers, bendable round bars which comprise, as central base cylinders, inclined cylinders passing the points P, Q and R respectively, are used. Alternatively, round pipes fixed on such base cylinders may be used. The rollers and guide faces for the right half are denoted by reference numerals without "'", and the rollers and guide faces for the left half are denoted by the same reference numerals with "'". This applies to denotation of other corresponding elements for the right and left halves. As shown in FIG. 2*c*, an auxiliary roller 64 is provided to enclose the pipe 60 to thereby prevent the tread step 5 connected with the roller 6 from being lifted off the pipe 60. Back-up wheels 31 arranged between both inclined axes (see FIG. 1*c*) support the tread face with their soft surfaces, resiliently. A pin of the tread step connecting roller chain 61 is formed to be hollow to serve as a pin hole, and a pin 55 projecting transversely from the tread step 5 is fitted in the hollow pin hole and supported, at its end, by a bracket 9 fixed to the tread step. The left and right halves of the train of tread steps are driven not at a terminal but at a plurality of positions on the traveling route by driving sprocket wheels 63 by motors 62 with reduction gears. Thus, the terminal does not occupy too much space, and load on the chain is reduced.

Figure 4:
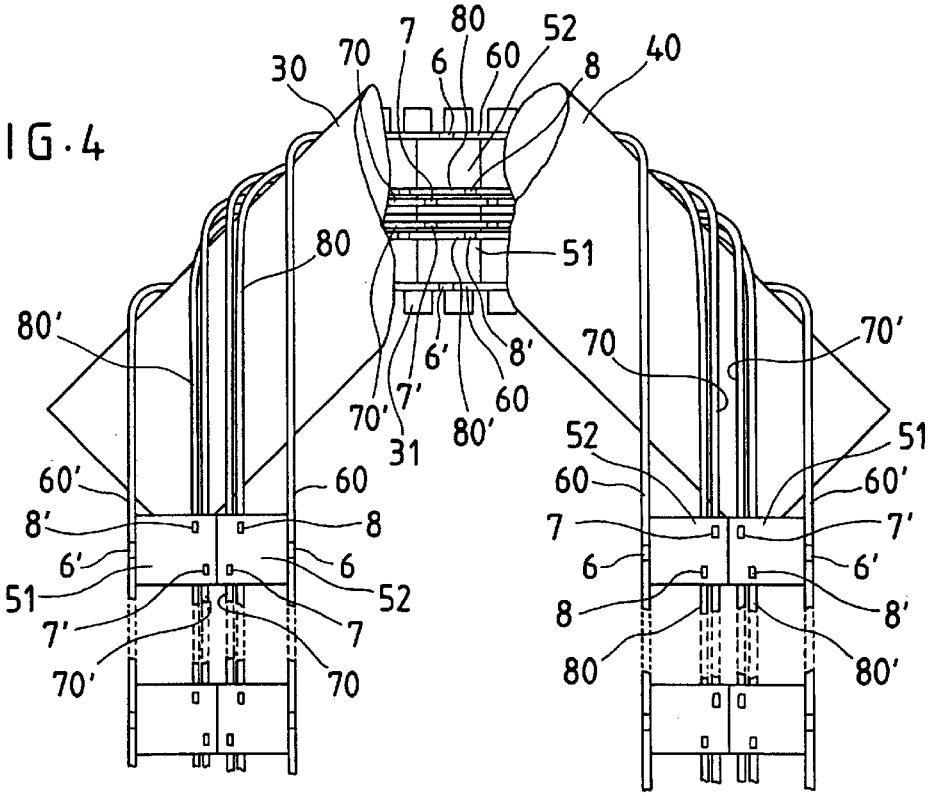
FIG. 4 is a plan view of a round-bar type guide surface in the vicinity of a turn-around section.

As shown in FIG. 4, both chains travel continuously in contact with basic roller guide faces on the basis of the inclined cylinders 30, 40. The left and right halves of each tread step are flexibly connected by the cylindrical pin 53 having the spring 54 at the central portion in the longitudinal direction and each guided helically by the associated guide surface made of a round bar, absorbing the dimension error of the guide surface, around the inclined cylinder 30 and the inclined cylinder 40. Having been turned around, the left and right halves are restored to their connected state.

(3) In the Case of a Belt-Type Escalator

Figure 6A:
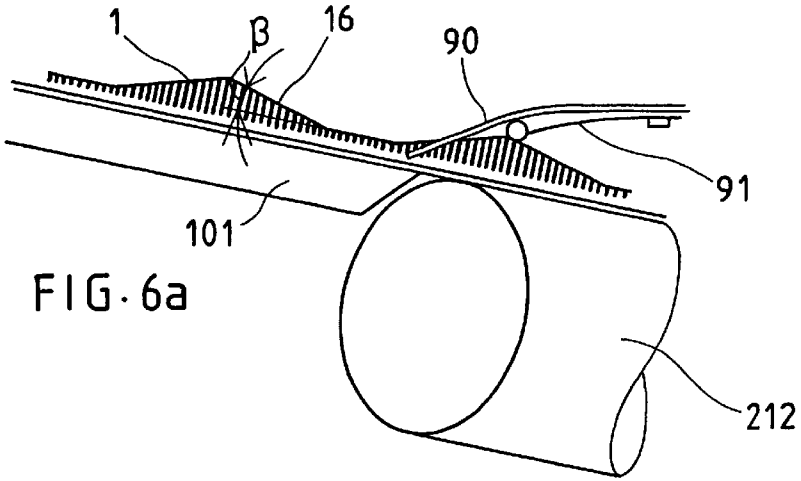
FIG. 6*a* is side view of a comb portion.
Figure 6B:
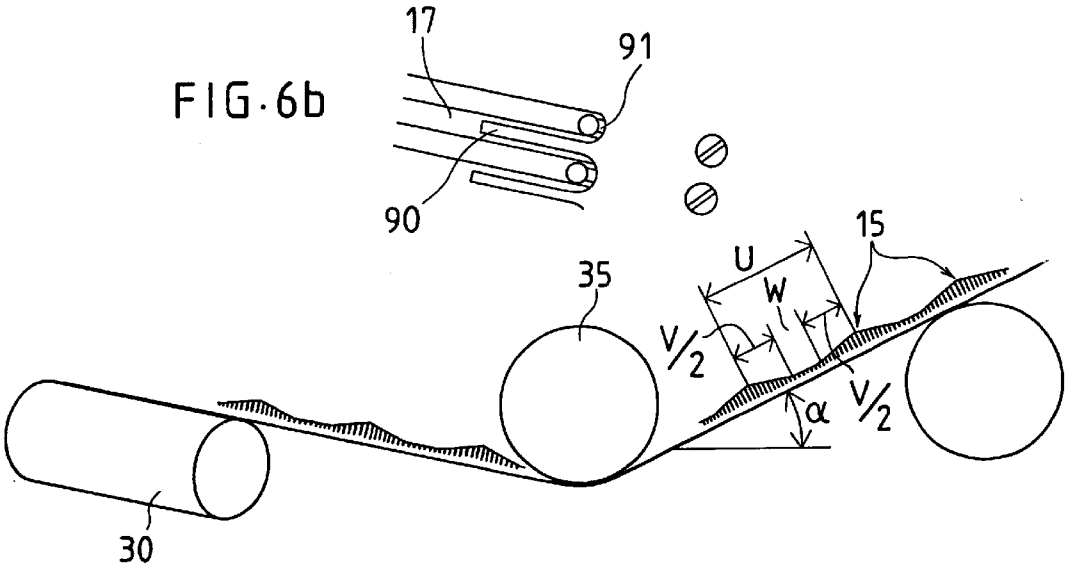
FIG. 6*b* is a plan view of the comb portion perpendicular to the traveling direction.
Figure 5:
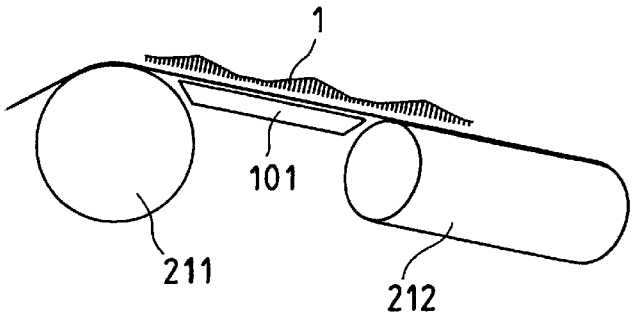
FIG. 5 is a schematic side view of a belt-type escalator (a moving handrail is omitted)

The ridges with slope of gentle inclination are provided on the belt at predetermined intervals, as shown in FIG. 5. The inclination of the inclined face which serves as a tread face is kept under the allowable limit for a moving slope (in the case of a metal face, 12°; in the case of a non-metal face, 15°). The tread face needs to be inclined upward in an ascending section and downward in a descending section. As shown in FIGS. 6*a* to 6*b*, ridge portions 15 of an isosceles triangle in cross section with base angles $\beta$ of about 8° to 15° are provided at pitches U of about 40 to 55 cm. The angle $\alpha$ of sloping traveling is about $2\beta$. In the shown example which takes special care that a person rides feeling at rest, $\beta$=12°, $\alpha$=24°, the width V of the ridge portion as measured in the traveling direction is 18×2 cm, the width W of a non-ridge portion as measured in the traveling direction is 10 cm, and the pitch U is 46 cm. In the case where a belt-type escalator of this kind is used as a subway staircase having an inclination of 0.5, $\alpha$=26°34' and $\beta$=13°17'. The toothed belt 1 has a plurality of transverse grooves 16 to increase the flexibility. The toothed belt 1 has also grooves 17 provided at equal intervals, with which teeth of a comb 90 engage. The depth of a space between the belt surface and the teeth of the comb 90 varies. Therefore, as shown in a side view of FIG. 6*a* and a plan view of FIG. 6*b*, a spring 91 whose ends go up and down following the belt surface is attached to the comb 90 for safety. If step-on and step-off portions are formed as slopes having an angle of inclination $\beta$, a person can smoothly step on and off the escalator because he steps onto a parallel plane. The escalator of this type has a simple structure. Therefore, it is favorable for mass production. Installation and maintenance are also easy. Therefore, it is suited to be installed in place of an existing staircase. A disk 35 is arranged near the edge of the belt.

(4) In the Case of Parallel Twistable Roller Chains Having Tread-face Elements

Figure 7A:
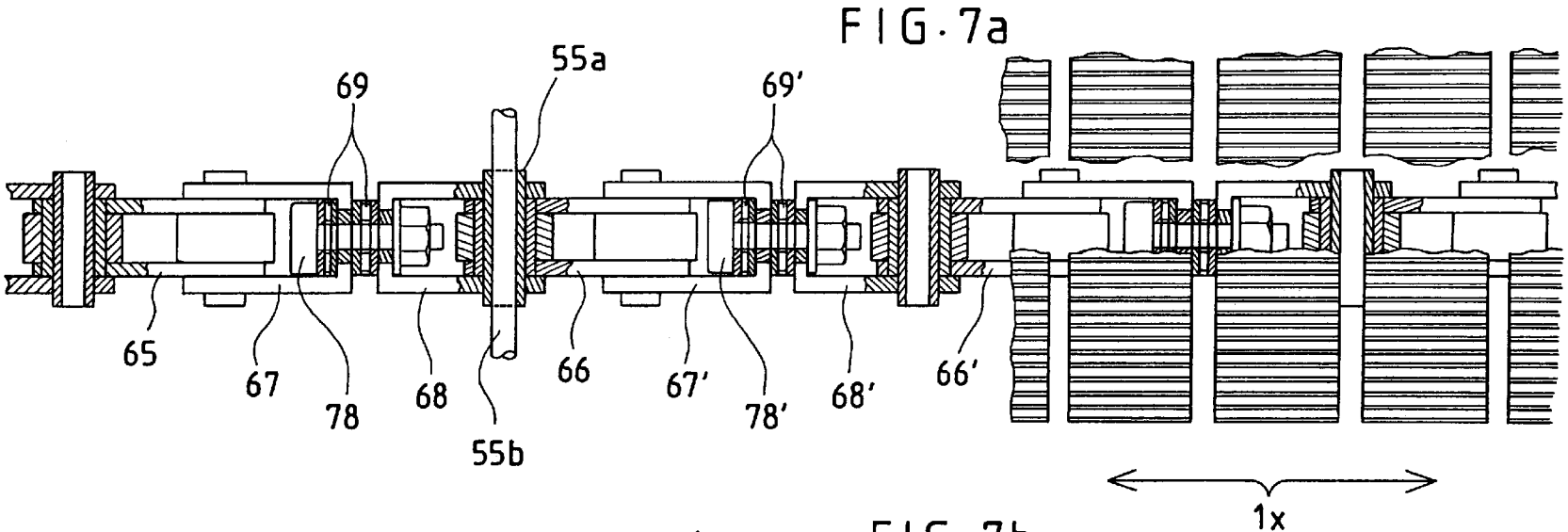
FIG. 7*a* is a plan view of a twistable roller chain having tread-face elements.
Figure 7B:
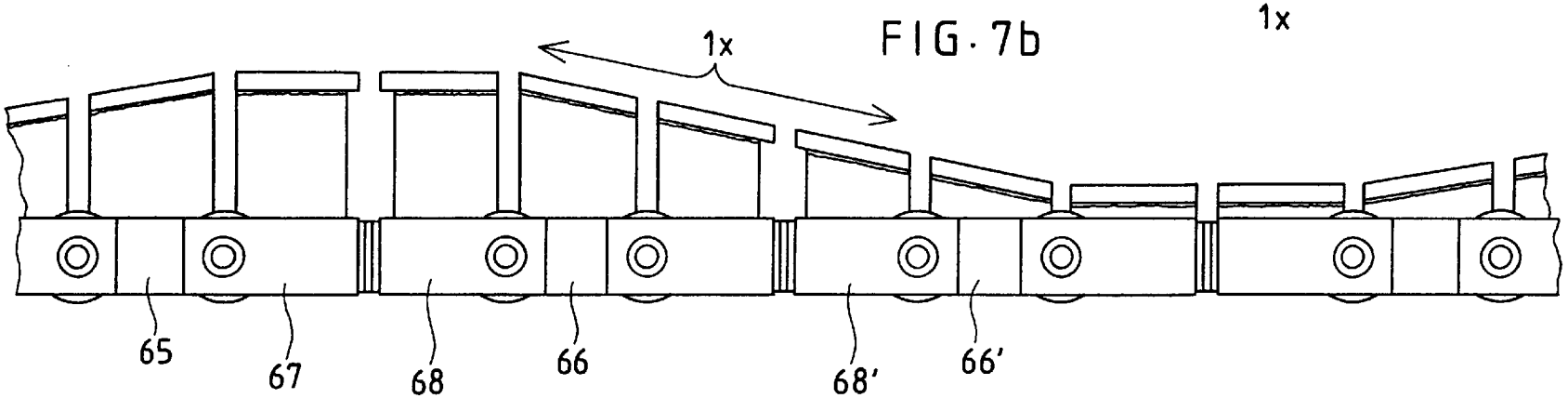
FIG. 7*b* is a side view of the same.

A structure in which two or more twistable roller chains having various tread-face elements 1*x* provided on one side of the roller chains at extended portions of connecting links of the roller chains are connected in parallel by elastic bars passing through hollow pins of the roller chains to thereby provide tread faces can be applied to a moving sidewalk, a moving slope and an escalator. In the case of a moving sidewalk or a moving slope, the tread face may be parallel to the traveling direction of the chains. In the case of an escalator, the tread-face is inclined. If the angle of inclination of sloping traveling is equal to or smaller than the regulation value of inclination of a slope, the angle of inclination $\beta$ may be equal to the angle of inclination $\alpha$ of sloping traveling. If the angle of inclination of sloping traveling exceeds the regulation value $\delta$ of inclination of a slope, the angle of inclination $\beta$ needs to be the regulation value $\delta$ or smaller. For example, in the case where $\delta$=12°, if $\alpha$=24° and $\beta$=12°, then the angle of inclination of the tread face relative to the horizontal plane is 12° (the inclination is upward in an ascending section and downward in a descending section). Thus, the tread face is not horizontal, but the inclination thereof is within the allowable range for a moving slope. FIGS. 7*a* and 7*b* show an example of a roller chain having tread-face elements which constitutes an escalator. FIG. 7*a* is a plan view, and FIG. 7*b* is a side view. The roller chain used in this example is basically the same as the twistable roller chain described in (3) and shown in FIGS. 3*a* and 3*b*, except that tread-face elements are provided on one side (in the shown example, the upper side) of the roller chain in a manner that they are arranged at the ends of extended portions of connecting links of the roller chain as shown in FIGS. 7*a* and 7*b*. The height of the extended portions of the connecting links is so determined that the tread-face elements may constitute a predetermined face comprising horizontal portions and sloping portions as shown in FIG. 7*b*. Gaps are provided between the tread-face elements so that the tread-face elements may not interfere with each other when the chain bends. An elastic bar 55*b* is passed through hollow pins 55*a* of both chains and fixed at its both ends to thereby arrange the chains side by side in order and keep them from being disordered when the chains pass the turn-around portion. The way of connecting a tread-face element to an extended portion of a link is not limited to a specific one. There are various ways such as fillet welding, screwing, fitting and the like. The tread-face element may also be formed by folding the extended portion. The distance between the adjacent chains in the transverse direction is determined in view of the width of the comb, and the length of the hollow pin is determined accordingly. In order to reduce frictional wear of the roller, needle roller bearings may be used. In the case of a moving sidewalk, the face serving as tread faces does not have sloping portions. In the case of a moving slope, it is general that the face serving as tread faces does not have sloping portions, but if the sloping portions are provided, the angle of inclination of the sloping portions are made equal to the angle of inclination of sloping traveling so that the inclined tread face may be parallel to the sloping traveling route.

(5) In the Case of a Moving Sidewalk Which Circulates in a Large Area

Figure 8A:
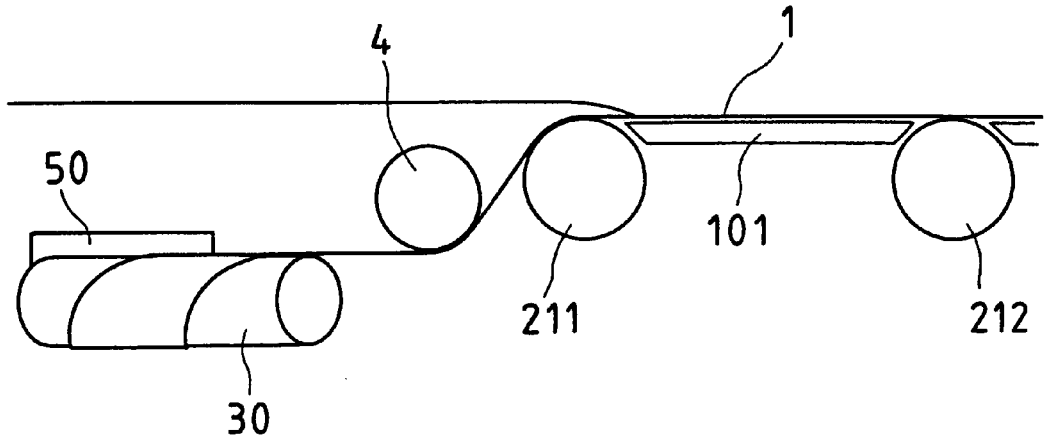
FIG. 8*a* is a plan view of a rectangular turn-around section.
Figure 8B:
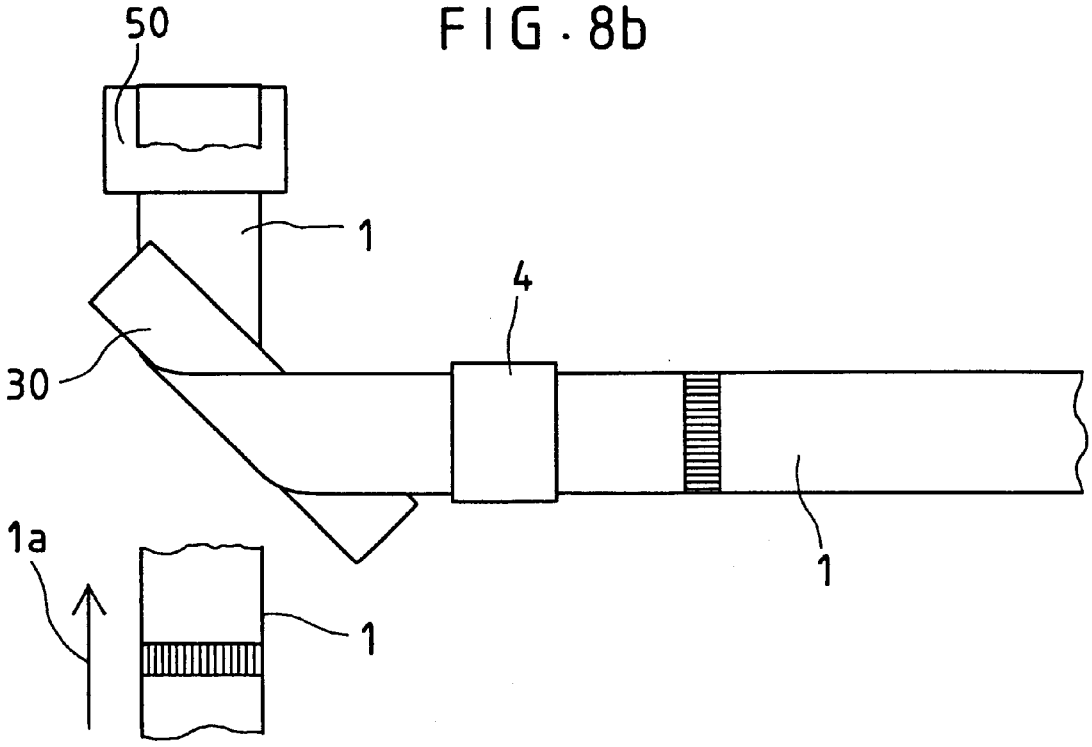
FIG. 8*b* is a side view of the same.
Figure 9A:
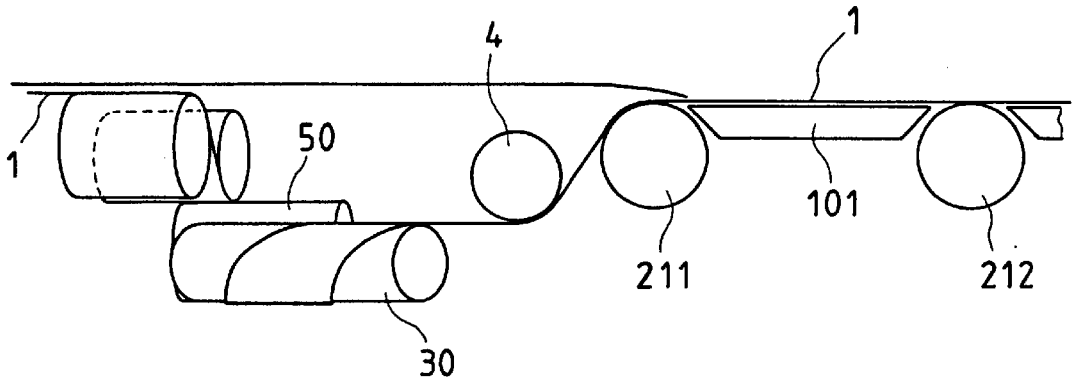
FIG. 9*a* is a plan view of a non-rectangular tuning around section.
Figure 9B:
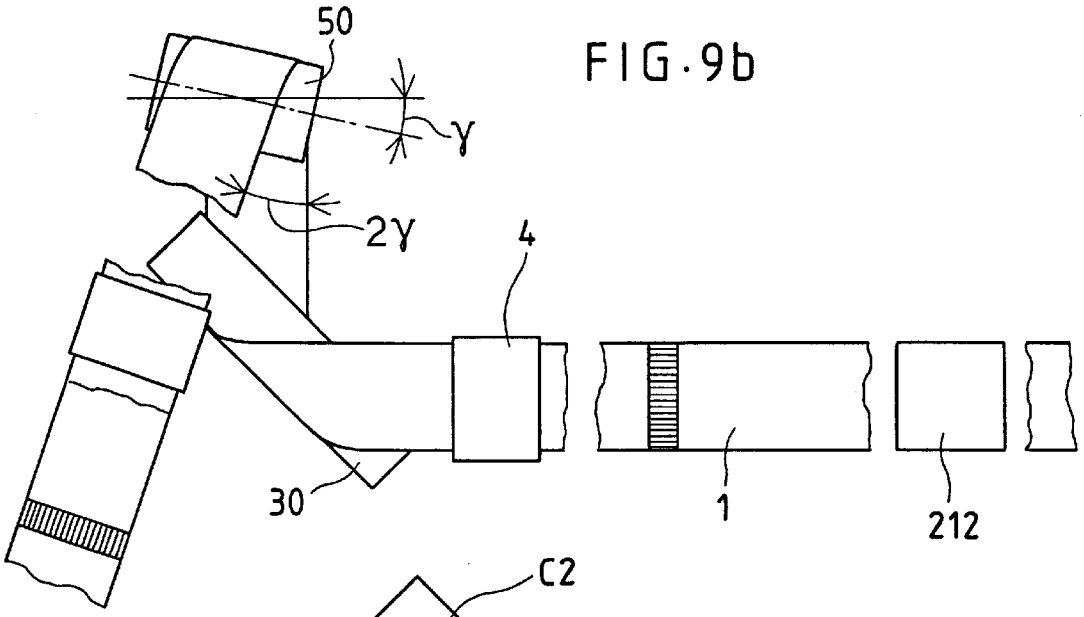
FIG. 9*b* is a side view of the same.
Figure 9C:
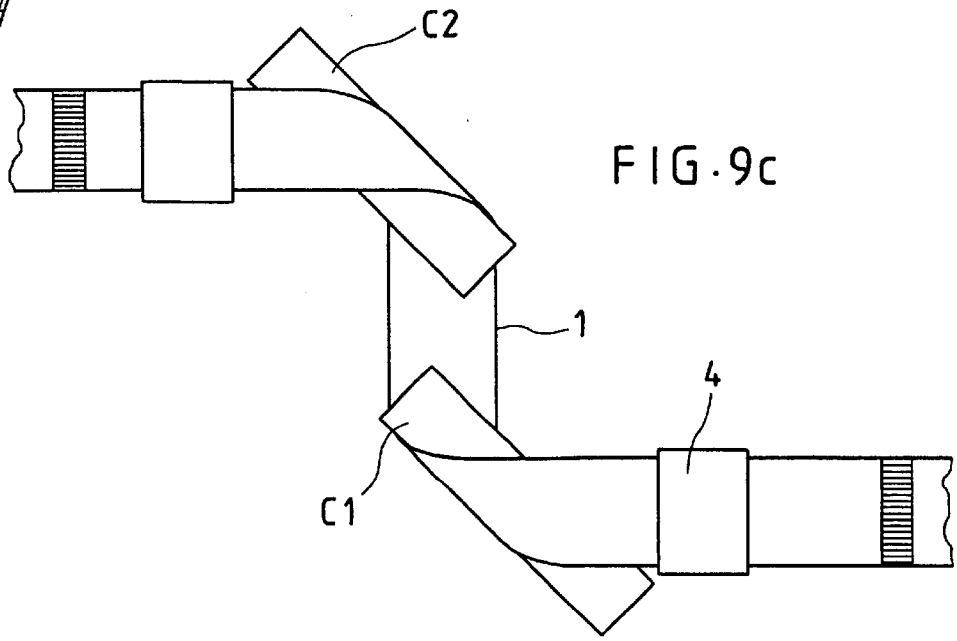
FIG. 9*c* is a plan view of a turn-around section in which a belt travels on another way parallel to the preceding way in the same direction.

A moving sidewalk which does not turn back immediately but turns around at the same angle successively to thereby make a round inside a large structure or the like will be described by an example of a belt-type moving sidewalk which turns at a right angle successively. As shown in FIGS. 8*a* and 8*b*, a belt is wound onto a cylinder 30 which is inclined at an angle of 45° and set under the floor, and then travels at a right angle to the preceding traveling direction. Then, the belt is wound by 180° on a large-diameter cylinder 50 which extends at a right angle to the traveling direction and whose diameter is larger than that of the inclined cylinder 30. Thus, the belt comes out as a walking sideway traveling at a right angle to the original traveling direction. By bending at an right angle four times, the belt makes a round. As shown in FIG. 9*b*, if the large-diameter cylinder 50 is inclined at an angel $\gamma$, the belt bends at an angle of $90°+2\gamma$. For example, in order that the belt may have a route in the shape of an equilateral polygon having N angles, $\gamma$ needs to be 45°–180°/N. The route of the belt can be arbitrarily determined by choosing the combination of the directions of the cylinder 30 and the large-diameter cylinder 50. As shown in FIG. 9*c*, by inserting two cylinders C1 and C2 in the circulating route of the belt with their axes parallel to each other, the belt can be made to travel on another route parallel with the preceding route in the same direction as before. The angle of inclination of the cylinders C1, C2 may be chosen arbitrarily, but an angle of 45° is generally practical. When a subway staircase having bends is to be replaced by an escalator, the structure shown in FIGS. 9*a* and 9*b* can be used to form a landing (horizontal plane) through which the escalator is bent. Thus the staircase having bends can be replaced by a continuously outgoing and returning escalator, which has been considered impossible.

(6) In the Case Where Increased Traveling Speed is Sought

Figure 10A:
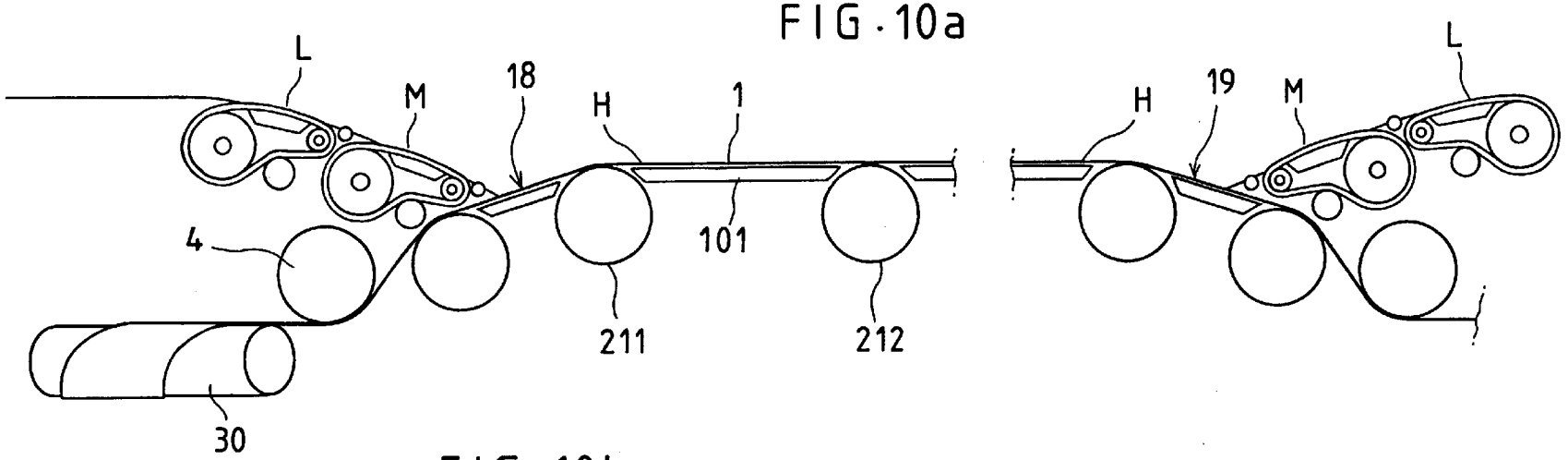
FIG. 10*a* is a side view of a high-speed moving sidewalk (a moving handrail is omitted)
Figure 10B:
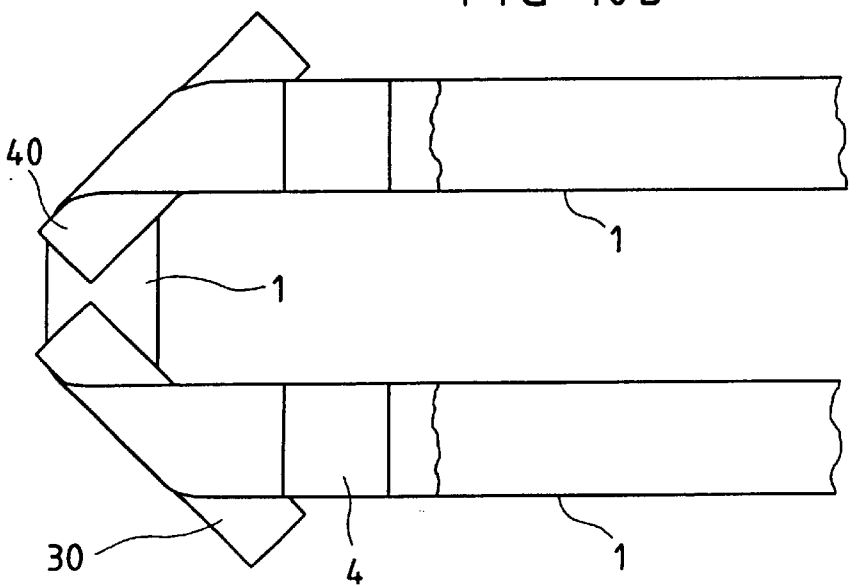
FIG. 10*b* is a plan view of a turn-around section.

In order to increase the traveling speed of the continuous conveying apparatus of the present invention, the invention entitled "high-speed continuous conveying system" by the present inventor, which is a co-pending application (based on Japanese Patent Application No. Hei 10-267182), can be applied to a high-speed traveling section. Generally, it is dangerous to step from the floor (stationary) directly onto a high-speed traveling tread face, and step from the high-speed traveling tread face directly onto the stationary floor. Therefore, it is generally arranged such that a person steps from the floor onto a low-speed traveling tread face, then onto a medium-speed traveling tread face and then onto a high-speed traveling tread face, and steps from a high-speed traveling tread face onto a medium-speed traveling tread face, then onto a low-speed traveling tread face and then onto the floor. In particular, structure for stepping onto or stepping from a high-speed tread face needs special attention. In order to have space for driving systems, it is desirable that transit tread faces are provided as moving slopes. An example in which the invention is applied to a walking sideway is shown in FIGS. 10*a* and 10*b*. Since the upper limit of an angle of inclination of a slope is regulated, inclination not exceeding the limit is imparted to a low-speed traveling section L, a medium-speed traveling section M and a high-speed traveling section H. To sum up, in this case, the continuous conveying apparatus of the present invention needs to have appropriate sloping portions 18, 19 at both ends of its high-speed traveling section.

Figure 11:
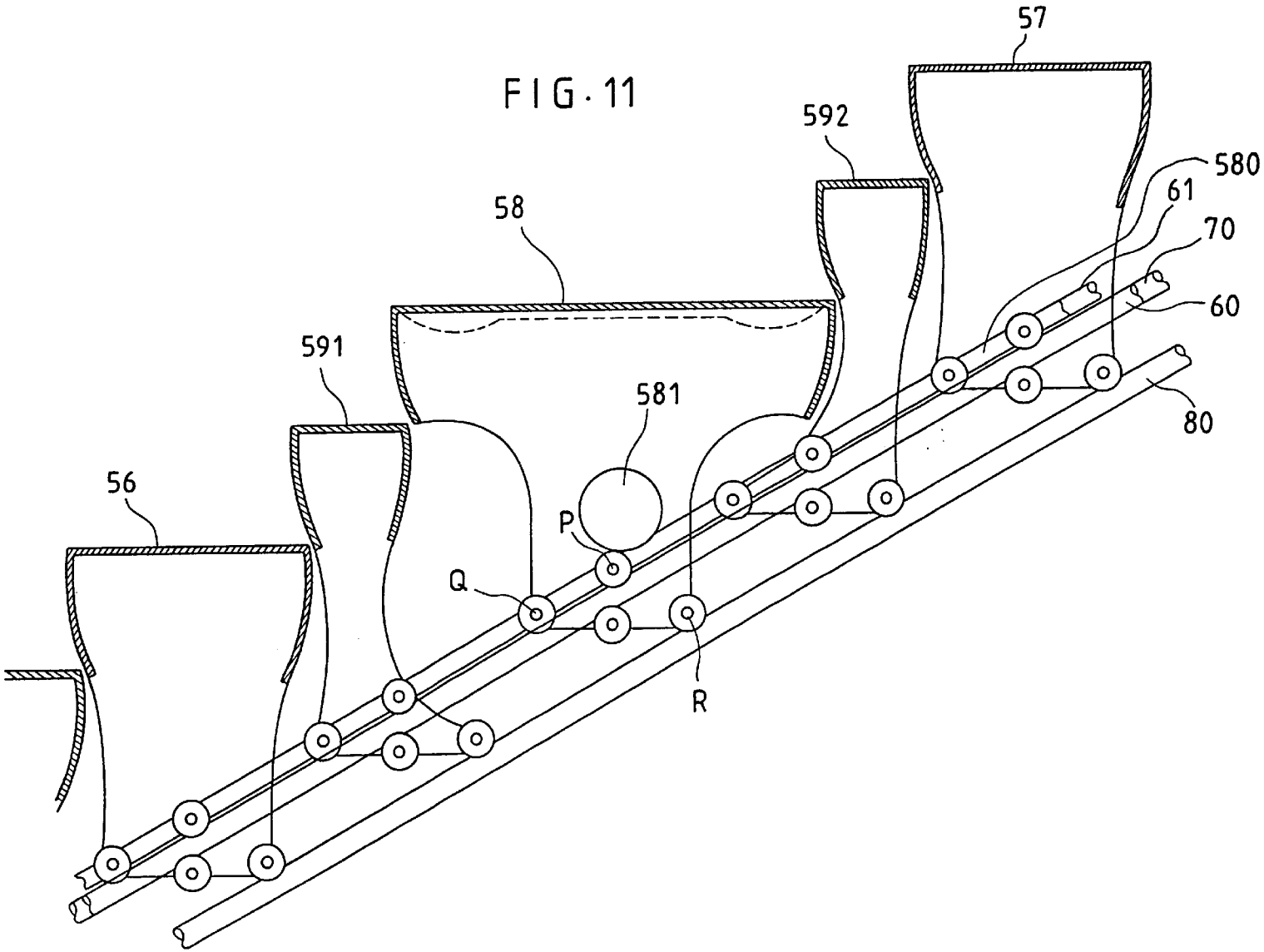
FIG. 11 is a side view of a special tread step for a wheelchair and its adjacent tread steps.

(7) In the Case of an Escalator Having a Permanently Mounted Tread Step for a Wheelchair A conventional escalator having a train of tread steps including tread steps so modified as to allow a person in a wheelchair to ride is now in use. On the other hand, the present inventor has filed an international application PCT/JP98/05127 regarding a system in which tread steps for a wheelchair are mounted permanently in order to simplify the structure of the system and make the system easier to use. An example in which the present invention is applied to the most simple structure according to the above invention will be described. Generally, the depth of a tread face needed for allowing a wheelchair to ride is considered to be 1100 to 1200 mm, while an appropriate depth of a tread face for a person's ride is considered to be 400 mm. However, practically, the depth of 270 to 280 mm is enough for a person to ride. Further, even when ordinary tread faces are provided to be 400 mm in depth, only approximately two thirds of all the tread steps are practically in use even in rush hour. In this view, in the present example, the depth of an ordinary tread face is chosen to be 280×2=560 mm to thereby increase utilization rate, the depth of a tread face for a wheelchair is chosen to be 280×4=1120 mm, and an extra extent of 1120–560=560 mm is divided in two and compensated by tread faces mounted before and after the tread face for a wheelchair. Thus, the depth of the tread faces mounted before and after the tread face for a wheelchair is 560–280=280 mm. FIG. 11 is a side view showing a train of tread steps of this example. Reference numerals 56, 57 denote ordinary tread steps on rails 60, 70 and 80, and a reference numeral 58 denotes a tread step for a wheelchair (having a concave portion serving as a wheel stop) with a large roller 581 on an extra rail 580, and reference numerals 591 and 592 denote mini-tread steps (arranged symmetrically). If the angle of inclination of sloping traveling is 27°, the height of a rise is 254 mm. As another example, the case will be taken where the depth of an ordinary tread step is 480 mm, the depth of a tread step for a wheelchair is 1200 mm, and an extra extent is divided into four and compensated by two tread steps before the tread step for a wheelchair and two tread steps after the tread step for a wheelchair, equally. In this case, the depth of a mini-tread step is 300 mm, and if the angle of inclination of sloping traveling is 27°, the height of a rise is 218 mm. Thus, this example is easier to use in the same manner as described in the case (2).

(8) In the Case Where Twistable Link Series are Used

Figure 12A:
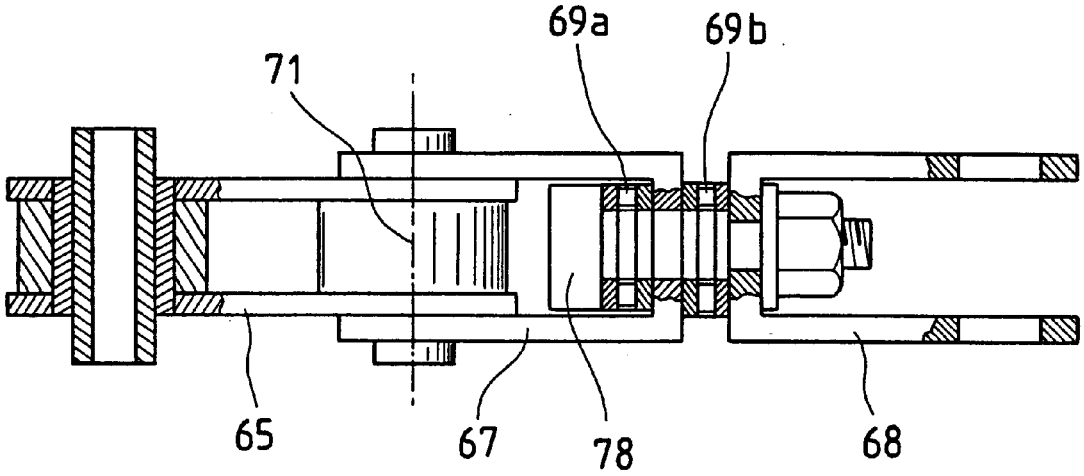
FIG. 12*a* is a side view of a twistable link series.
Figure 12B:
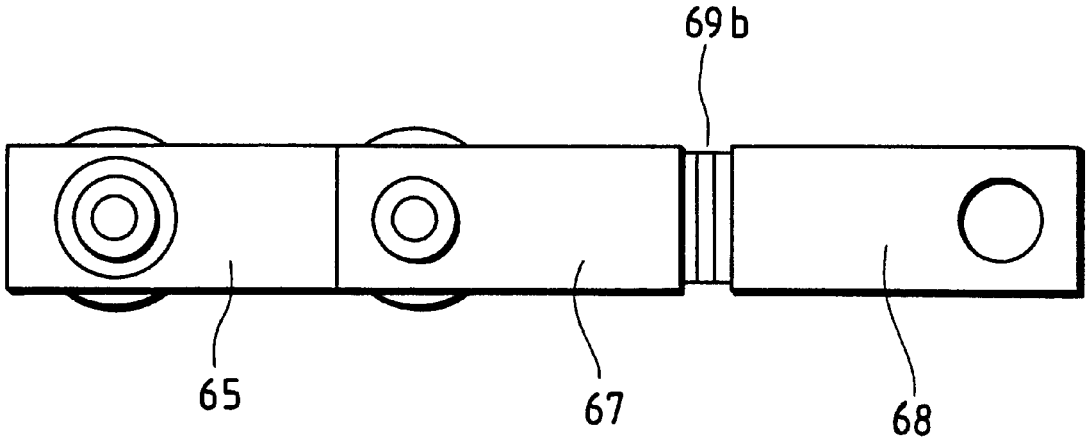
FIG. 12*b* is a plan view of the same.

The case where twistable link series are used as driving elements is equivalent to the case where the pitch of the chain is equal to the pitch between tread steps in the structure (2) using the roller chains. An example of link structure shown in FIGS. 12*a* and 12*b* is similar to the structure shown in FIGS. 3*a* and 3*b*. Rollers 61*a*, 61*b* of a roller link 65 having a pin hole in which a pin 55 is inserted have teeth with which the link series is driven. U-shaped links 67, 68 are connected by a longitudinal bolt 78 using thrust bearings 69*a*, 69*b*. If the links are locked at an axis 71 so that they can not bend, the link series can be driven by pushing, unlike the roller chain.

(9) Last, the Case Where a Train of Tread Steps is Raised Up by Being Twisted by 90° and then turned around in that state will be described.

As shown in a side view of FIG. 13*a* and a plan view of FIG. 13*b*, in order to prevent tread steps from touching the floor, a special sloping traveling section E→F is provided in which each tread step X is, by a helical guide face, twisted by 90° and thereby raised up with its tread face X0 outside. Between the Xth tread face and the (X+1)th tread face, there occurs a difference $\epsilon$ in angle of twist corresponding to the depth S of a tread face (≈pitch between tread steps). After passing a buffer section FG (with a curvature of 1/Re), the train of tread steps is turned around by an upper sprocket wheel S1 and a lower roller guide face S2 (circular in shape), then passes a buffer section G'F' and proceeds to an untwisting section F'E'. In order to prevent tread faces from colliding with each other when they approach each other duing their helicoidal movement, alternating portions having a depth of S(1-cos$\epsilon$) or more with left and right spaces (formed by ridges X01, groove-bottom projecting portions X02 and groove-bottom concave portions X03 packed with foam rubber for safety) are provided.

Between the tread steps, there occurs a difference in angle of twist corresponding the depth of a tread face. The tread steps are raised up at most at 90°, and passes the buffer circular section FG (having a radius Re). Then, in the circular turn-around section C0, an upper chain 61 engages with the sprocket wheel S1, and a lower chain 61' is guided by the circular guide face S2. Thus, power is transmitted.

Then the tread faces are gradually untwisted from 90° to 0° while they travel from G' through F' to E'. In the shown example, if S=300 mm, the transverse width is 400 mm, and the section for raising up tread faces is 1800 mm in length, then a difference in angle between adjacent tread faces is 90°÷6=15° and risers do not interfere with each other. Unlike the case where a train of tread faces is turned around by being turned over, each tread face is not divided in two. This way of turning around is suited for the case where the transverse width of tread faces is small.

Meanwhile, the whole traveling process can be shortened by interconnecting the helical motion, the inclined traveling motion and the turning around motion and by any combination of the above motions.

As described above, according to the present invention, a continuous conveying apparatus having continuously connected going and returning ways in which tread faces travel stably and are turned around or folded while maintaining their left and right driving systems. The conveying apparatus can be installed by utilizing almost part of the existing steps at smaller expenses.

What is claimed is:

1. A continuous conveying apparatus comprising:

a flexible conveying member that forms a plurality of contiguous tread steps connected to one another, that is divided into two halves at a centerline in the traveling direction of the flexible conveying member;

a flexible element connecting the two halves with each other that permits a torsional motion of the two halves; and a guide mechanism that turns a traveling direction of the flexible conveying member by helicoidally guiding the flexible conveying member to change the traveling direction of the contiguous tread steps while maintaining the contiguousness thereof.

2. A continuous conveying apparatus according to claim 1, further comprising:

a plurality of support rollers rotatably supported at horizontal axes that pass through a plurality of vertex and base apexes of an isosceles triangle with the vertex on a perpendicular bisector of each tread face when viewed from a side of each tread step; and a plurality of twistable roller chains that drive a plurality of horizontal pins provided at a center of each of the two halves; and a plurality of supporting members that guide the support rollers.

3. A continuous conveying apparatus according to claim 1, wherein the guide mechanism further comprises:

a first guide member that helicoidally guides the flexible conveying member around a first axis inclined with respect to the traveling direction of the flexible conveying member to turn the traveling direction of the contiguous tread steps; and a second guide member that helicoidally guides the conveying member around a second axis.

4. A continuous conveying apparatus according to claim 2, wherein the flexible conveying member further comprises:

a driving power receiving portion; and a supporting portion, such that the first guide member guides the driving power receiving portion and the supporting portion so that the flexible conveying member is turned with the contiguous tread steps directed outside, and the second guide member guides the driving power receiving portion and the supporting portion so that the flexible conveying member is turned with the tread faces directed outside to proceed to a subsequent traveling direction.

5. A continuous conveying apparatus, wherein the flexible conveying member further comprises:

a flexible conveying member that forms a plurality of contiguous tread steps connected to one another;

a guide mechanism that turns a traveling direction of the flexible conveying member by helicoidally guiding the flexible conveying member to change the traveling direction of the contiguous tread steps while maintaining the contiguousness thereof;

a plurality of twistable roller chains provided parallel with each other;

a contiguous tread step face mounted on an extended portion of each connecting link of the plurality of twistable roller chains; and a plurality of elastic pins connecting the plurality of twistable roller chains.

* * * * *

UNITED STATES PATENT AND TRADEMARK OFFICE

CERTIFICATE OF CORRECTION

PATENT NO. : 6,357,572 B2
DATED : March 19, 2002
INVENTOR(S) : Masao Kubota

It is certified that error appears in the above-identified patent and that said Letters Patent is hereby corrected as shown below:

Column 10,
Line 14, change “2” to -- 3 --.

Signed and Sealed this

Twenty-seventh Day of August, 2002

*Attest:*

*Attesting Officer*

JAMES E. ROGAN
*Director of the United States Patent and Trademark Office*